US006761031B2

(12) United States Patent
Bunker

(10) Patent No.: US 6,761,031 B2
(45) Date of Patent: Jul. 13, 2004

(54) DOUBLE WALL COMBUSTOR LINER SEGMENT WITH ENHANCED COOLING

(75) Inventor: Ronald Scott Bunker, Niskayuna, NY (US)

(73) Assignee: General Electric Company, Schenectady, NY (US)

( * ) Notice: Subject to any disclaimer, the term of this patent is extended or adjusted under 35 U.S.C. 154(b) by 0 days.

(21) Appl. No.: 10/065,108

(22) Filed: Sep. 18, 2002

(65) Prior Publication Data

US 2004/0050059 A1 Mar. 18, 2004

(51) Int. Cl.[7] ..... F02C 7/12; F23R 3/42

(52) U.S. Cl. ..... 60/752; 60/756; 60/757; 60/39.37

(58) Field of Search ..... 60/39.37, 752, 60/756, 757

(56) References Cited

U.S. PATENT DOCUMENTS

| | | | | |
|---|---|---|---|---|
| 1,848,375 A | * | 3/1932 | Muir | 165/153 |
| 2,801,073 A | * | 7/1957 | Savage | 416/96 A |
| 2,938,333 A | | 5/1960 | Wetzler | |
| 3,229,763 A | | 1/1966 | Rosenblad | |
| 3,572,031 A | * | 3/1971 | Szetela | 60/757 |
| 3,664,928 A | | 5/1972 | Roberts | |
| 3,899,882 A | | 8/1975 | Parker | |
| 4,158,949 A | | 6/1979 | Reider | |
| 4,184,326 A | | 1/1980 | Pane, Jr. et al. | |
| 4,838,031 A | | 6/1989 | Cramer | |
| 5,024,058 A | * | 6/1991 | Shekleton et al. | 60/752 |
| 5,353,865 A | | 10/1994 | Adiutori et al. | |
| 5,361,828 A | | 11/1994 | Lee et al. | |
| 5,363,654 A | * | 11/1994 | Lee | 60/752 |
| 5,419,039 A | * | 5/1995 | Auxier et al. | 29/889.721 |
| 5,421,158 A | | 6/1995 | Stenger et al. | |
| 5,460,002 A | | 10/1995 | Correa | |
| 5,651,662 A | | 7/1997 | Lee et al. | |
| 5,660,525 A | | 8/1997 | Lee et al. | |
| 5,681,144 A | | 10/1997 | Spring et al. | |
| 5,695,321 A | | 12/1997 | Kercher | |
| 5,724,816 A | | 3/1998 | Ritter et al. | |
| 5,738,493 A | | 4/1998 | Lee et al. | |
| 5,758,503 A | | 6/1998 | DuBell et al. | |
| 5,797,726 A | | 8/1998 | Lee | |

(List continued on next page.)

FOREIGN PATENT DOCUMENTS

| | | | |
|---|---|---|---|
| JP | 61-280390 | | 12/1986 |
| JP | 408110012 A | | 4/1996 |
| JP | 9-217994 | | 8/1997 |
| JP | 2001-164901 | * | 6/2001 |

OTHER PUBLICATIONS

"Corporate Research and Development Technical Report Abstract Page and Sections 1–2," Bunker et al., Oct. 2001.
"Corporate Research and Development Technical Report Section 3," Bunker et al., Oct. 2001.
"Thermohydraulics of Flow Over Isolated Depressions (Pits, Grooves) in a Smooth Wall," Afanas'yev et al., Heat Transfer Research, vol. 25, No. 1, 1993.
Mass/Heat Transfer in Rotating Dimpled Turbine–Blade Coolant Passages, Charya et al., Louisiana St. University, 2000.

(List continued on next page.)

*Primary Examiner*—Ted Kim
(74) *Attorney, Agent, or Firm*—Nixon & Vanderhye P.C.

(57) ABSTRACT

A connector segment for connecting a combustor liner and a transition piece in a gas turbine has a substantially cylindrical shape and is of double-walled construction including inner and outer walls and a plurality of cooling channels extending axially along the segment, between the inner and outer walls. The cooling channels are defined in part by radially inner and outer surfaces, wherein at least one of the radially inner and outer surfaces is formed with an array of concavities.

12 Claims, 4 Drawing Sheets

U.S. PATENT DOCUMENTS

| | | | | |
|---|---|---|---|---|
| 5,822,853 | A | | 10/1998 | Ritter et al. |
| 5,933,699 | A | | 8/1999 | Ritter et al. |
| 5,975,850 | A | | 11/1999 | Abuaf et al. |
| 6,098,397 | A | | 8/2000 | Glezer et al. |
| 6,134,877 | A | | 10/2000 | Alkabie |
| 6,190,120 | B1 | | 2/2001 | Thatcher et al. |
| 6,237,344 | B1 | | 5/2001 | Lee |
| 6,314,716 | B1 | * | 11/2001 | Abreu et al. ..... 60/795 |
| 6,334,310 | B1 | | 1/2002 | Sutcu et al. |
| 6,402,464 | B1 | | 6/2002 | Chiu et al. |
| 6,408,629 | B1 | | 6/2002 | Harris et al. |
| 6,412,268 | B1 | | 7/2002 | Cromer et al. |
| 6,468,669 | B1 | | 10/2002 | Hasz et al. |
| 6,494,044 | B1 | | 12/2002 | Bland |
| 6,504,274 | B2 | * | 1/2003 | Bunker et al. ..... 310/64 |
| 6,526,756 | B2 | | 3/2003 | Johnson et al. |
| 2001/0005241 | A1 | | 6/2001 | Pantow et al. |

OTHER PUBLICATIONS

"Effect of Surface Curvature on Heat Transfer and Hydrodynamics within a Single Hemispherical Dimple," Proceedings of ASME TURBOEXPO 2000, May 8–11, 2000, Munich Germany.

"Concavity Enhanced Heat Transfer in an Internal Cooling Passage," Chyu et al., presented at the International Gas Turbine & Aeroengine Congress & Exhibition, Orlando, Florida, Jun. 2–5, 1997.

"Heat Transfer Augmentation Using Surfaces Formed by a System of Spherical Cavities," Belen'kiy et al., Heat Transfer Research, vol. 25, No. 2, 1993.

"Experimental Study of the Thermal and Hydraulic Characteristics of Heat–Transfer Surfaces Formed by Spherical Cavities," Institute of High Temperatures, Academy of Sciences of the USSR. Original article submitted Nov. 28, 1990.

"Turbulent Flow Friction and Heat Transfer Characteristics for Spherical Cavities on a Flat Plate," Afanasyev et al., Experimental Thermal and Fluid Science, 1993.

"Convective Heat Transfer in Turbulized Flow Past a Hemispherical Cavity," Heat Transfer Research, vol. 25, Nos. 2, 1993.

Patent application Ser. No. 10/010,549, filed Nov. 8, 2001.

Patent application Ser. No. 10/063,467, filed Apr. 25, 2002.

Patent application Ser. No. 10/162,755, filed Jun. 6, 2002.

Patent application Ser. No. 10/162,766, filed Jun. 6, 2002.

Patent application Ser. No. 10/064,605, filed Jul. 30, 2002.

Patent application Ser. No. 10/065,495, filed Oct. 24, 2002.

Patent application Ser. No. 10/065,115, filed Sep. 18, 2002.

Patent application Ser. No. 10/065,814, filed Nov. 22, 2002.

Patent application Ser. No. 10/301,672, filed Nov. 22, 2002.

* cited by examiner

DOUBLE WALL COMBUSTOR LINER SEGMENT WITH ENHANCED COOLING

BACKGROUND OF INVENTION

This invention relates generally to turbine components and more particularly to a generally cylindrical connector segment that connects a combustor liner to a transition piece in land based gas turbines.

Traditional gas turbine combustors use diffusion (i.e., non-premixed) flames in which fuel and air enter the combustion chamber separately. The process of mixing and burning produces flame temperatures exceeding 3900 degrees F. Since conventional combustors and/or transition pieces having liners are generally capable of withstanding for about ten thousand hours (10,000) a maximum temperature on the order of only about 1500 degrees F., steps to protect the combustor and/or transition piece, as well as the intervening connecting segment, must be taken. This has typically been done by film-cooling which involves introducing the relatively cool compressor air into a plenum surrounding the outside of the combustor. In this prior arrangement, the air from the plenum passes through louvers in the combustor liner and then passes as a film over the inner surface of the combustor liner, thereby maintaining combustor liner integrity.

Because diatomic nitrogen rapidly disassociates at temperatures exceeding about 3000° F. (about 1650° C.), the high temperatures of diffusion combustion result in relatively large NOx emissions. One approach to reducing NOx emissions has been premix the maximum possible amount of compressor air with fuel. The resulting lean premixed combustion produces cooler flame temperatures and thus lower NOx emissions. Although lean premixed combustion is cooler than diffusion combustion, the flame temperature is still too hot for prior conventional combustor components to withstand.

Furthermore, because the advanced combustors premix the maximum possible amount of air with the fuel for NOx reduction, little or no cooling air is available, making film-cooling of the combustor liner and transition piece impossible. Thus, means such as thermal barrier coatings in conjunction with "backside" cooling have been considered to protect the combustor liner and transition piece from destruction by such high heat. Backside cooling involved passing the compressor air over the outer surface of the combustor liner and transition piece prior to premixing the air with the fuel.

Lean premixed combustion reduces NOx emissions by producing lower flame temperatures. However, the lower temperatures, particularly along the inner surface or wall of the combustor liner, tend to quench oxidation of carbon monoxide and unburned hydrocarbons and lead to unacceptable emissions of these species. To oxidize carbon monoxide and unburned hydrocarbons, a liner would require a thermal barrier coating of extreme thickness (50–100 mils) so that the surface temperature could be high enough to ensure complete burnout of carbon monoxide and unburned hydrocarbons. This would be approximately 1800–2000 degrees F. bond coat temperature and approximately 2200 degrees F. TBC (Thermal Barrier Coating) temperature for combustors of typical lengths and flow conditions. However, such thermal barrier coating thicknesses and temperatures for typical gas turbine component lifetimes are beyond current materials known capabilities. Known thermal barrier coatings degrade in unacceptably short times at these temperatures and such thick coatings are susceptible to spallation.

Advanced cooling concepts now under development require the fabrication of complicated cooling channels in thin-walled structures. The more complex these structures are, the more difficult they are to make using conventional techniques, such as casting. Because these structures have complexity and wall dimensions that may be beyond the castability range of advanced superalloys, and which may exceed the capabilities of the fragile ceramic cores used in casting, both in terms of breakage and distortion, new methods of fabricating must be developed to overcome these prior limitations. Possible geometries for enhanced cooling are disclosed in, for example, commonly owned U.S. Pat. Nos. 5,933,699; 5,822,853; and 5,724,816. By way of further example, enhanced cooling in a combustor liner is achieved by providing concave dimples on the cold side of the combustor liner as described in U.S. Pat. No. 6,098,397.

In some gas turbine combustor designs, a generally cylindrical segment that connects the combustion liner to the transition piece and also requires cooling. This so-called combustor liner segment is a double-wall piece with cooling channels formed therein that are arranged longitudinally in a circumferentially spaced array, with introduction of cooling air from one end only of the segment. The forming of these cooling channels (as in U.S. Pat. No. 5,933,699, for example) has been found, however, to produce undesirably rough surfaces, and in addition, the design does not allow for the spaced introduction of coolant along the segment.

Accordingly, there is a need for enhanced cooling in the segment connecting the combustion liner and transition piece that can withstand high combustion temperatures.

SUMMARY OF INVENTION

This invention provides a generally cylindrical double-wall segment for connecting the combustion liner and the transition piece with enhanced cooling achieved by the inclusion of concavity arrays on one or both major surfaces of each cooling channel, thereby providing as much as 100% cooling improvement. As a result, the channels may then also be extended by as much as two times their original length without increasing the volume of required cooling air. This arrangement also allows the cooling air to be fed in by impingement cooling holes spaced axially along the segment, rather than forced in only at one end of the segment.

In the exemplary embodiments, one or both major surfaces of the double-walled cooling channels are machined to include arrays of concavities that are generally closely spaced together, but may vary in spacing depending upon specific application needs. The spacing, cavity depth, cavity diameter, and channel height determine the resulting thermal enhancement obtained. The concavities themselves may be hemispherical, partially hemispherical, ovaloid, or non-axisymmetric shapes of generally spherical form. Cooling air is either introduced at one end of the channels, or alternately, through axially spaced impingement cooling holes, in combination with the cooling air inlet at one end of the segment.

The formation of arrays of surface concavities on the "hot" side of the double-walled channels creates a heat transfer enhancement by so-called whirlwind effect from each cavity. The placement of similar arrays on the "cold" surface also serves to enhance heat transfer if the walls are spaced closely together. Due to the bulk vortex mixing motion of the flow interaction with the cavities, the friction factor increase is small compared to that of a smooth surface. This overall cooling enhancement allows less total coolant to be used at any location in the channels. Moreover, by spacing the introduction of cooling air into the channels using impingement holes, the resultant effect is that the overall length of the enhanced double wall segment may be extended by about two times, without the use of additional coolant.

Accordingly, in its broader aspects, the present invention relates to a connector segment for connecting a combustor liner and a transition piece in a gas turbine, the connector segment having a substantially cylindrical shape and being of double-walled construction including inner and outer walls and a plurality of cooling channels extending axially along the segment, between the inner and outer walls, the cooling channels defined in part by radially inner and outer surfaces, wherein at least one of the radially inner and outer surfaces is formed with an array of concavities.

In another aspect, the invention relates to a connector segment for connecting a combustor liner and a transition piece in a gas turbine, the connector segment having a substantially cylindrical shape and being of double-walled construction including inner and outer walls and a plurality of cooling channels extending axially along the segment, between the inner and outer walls, the cooling channels defined in part by radially inner and outer surfaces; wherein both of the radially inner and outer surfaces are formed with an array of concavities; and further comprising axially spaced holes in the outer wall communicating said plurality of cooling channels.

The invention will now be described in detail in conjunction with the following drawings.

DETAILED DESCRIPTION

Figure 1:
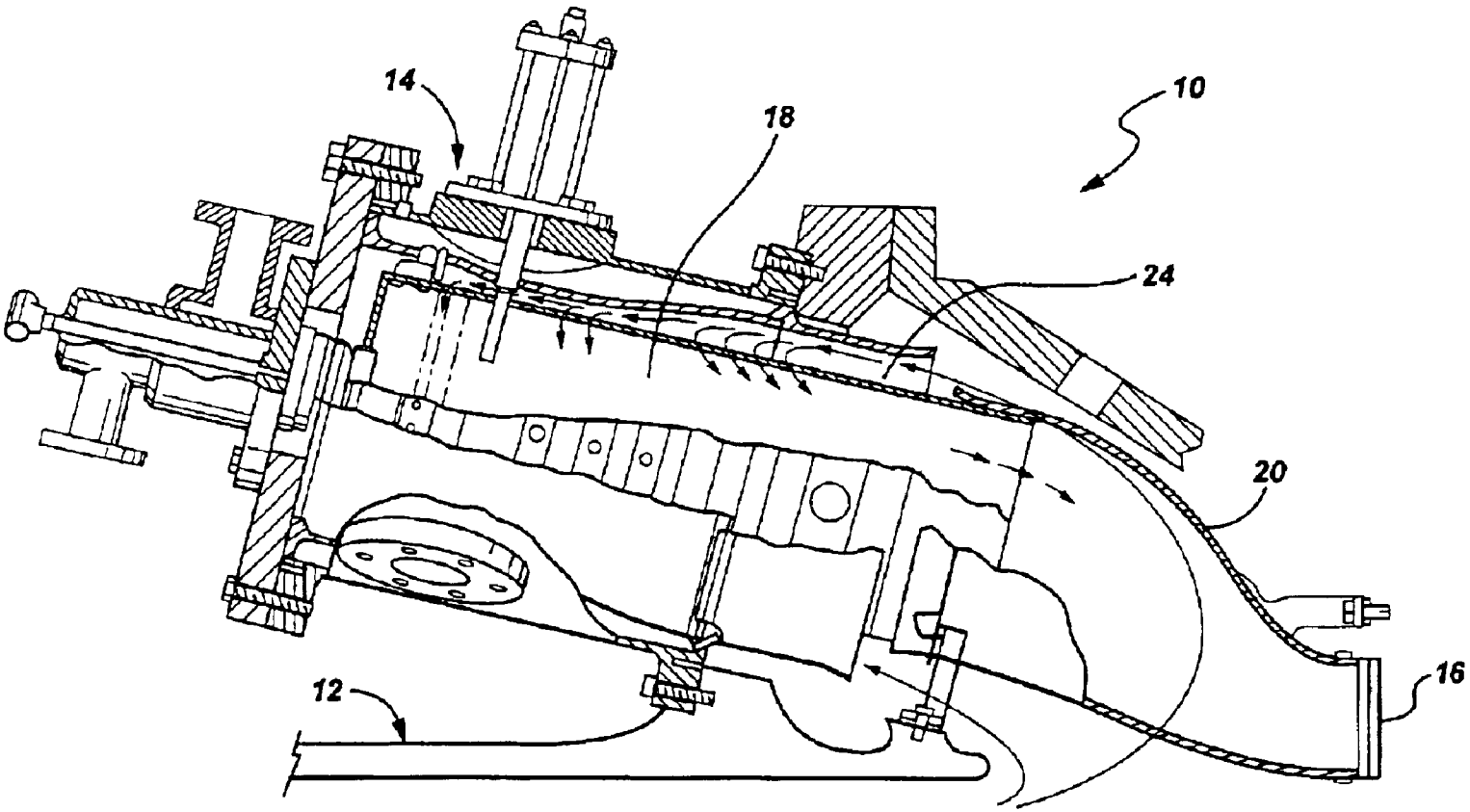
Fig. 1 (Prior Art)
FIG. 1 is a schematic representation of a known gas turbine combustor.

FIG. 1 schematically illustrates a typical can annular reverse-flow combustor 10 driven by the combustion gases from a fuel where a flowing medium with a high energy content, i.e., the combustion gases, produces a rotary motion as a result of being deflected by rings of blading mounted on a rotor. In operation, discharge air from the compressor 12 (compressed to a pressure on the order of about 250–400 lb/in$^2$) reverses direction as it passes over the outside of the combustors (one shown at 14) and again as it enters the combustor en route to the turbine (first stage indicated at 16). Compressed air and fuel are burned in the combustion chamber 18, producing gases with a temperature of about 1500° C. or about 2730° F. These combustion gases flow at a high velocity into turbine section 16 via transition piece 20.

A connector segment 22 (FIG. 2) may be located between the transition piece 20 and the combustor liner 24 that surrounds the combustion chamber 18.

In the construction of combustors and transition pieces, where the temperature of the combustion gases is about or exceeds about 1500° C., there are no known materials which can survive such a high intensity heat environment without some form of cooling.

Figure 2:
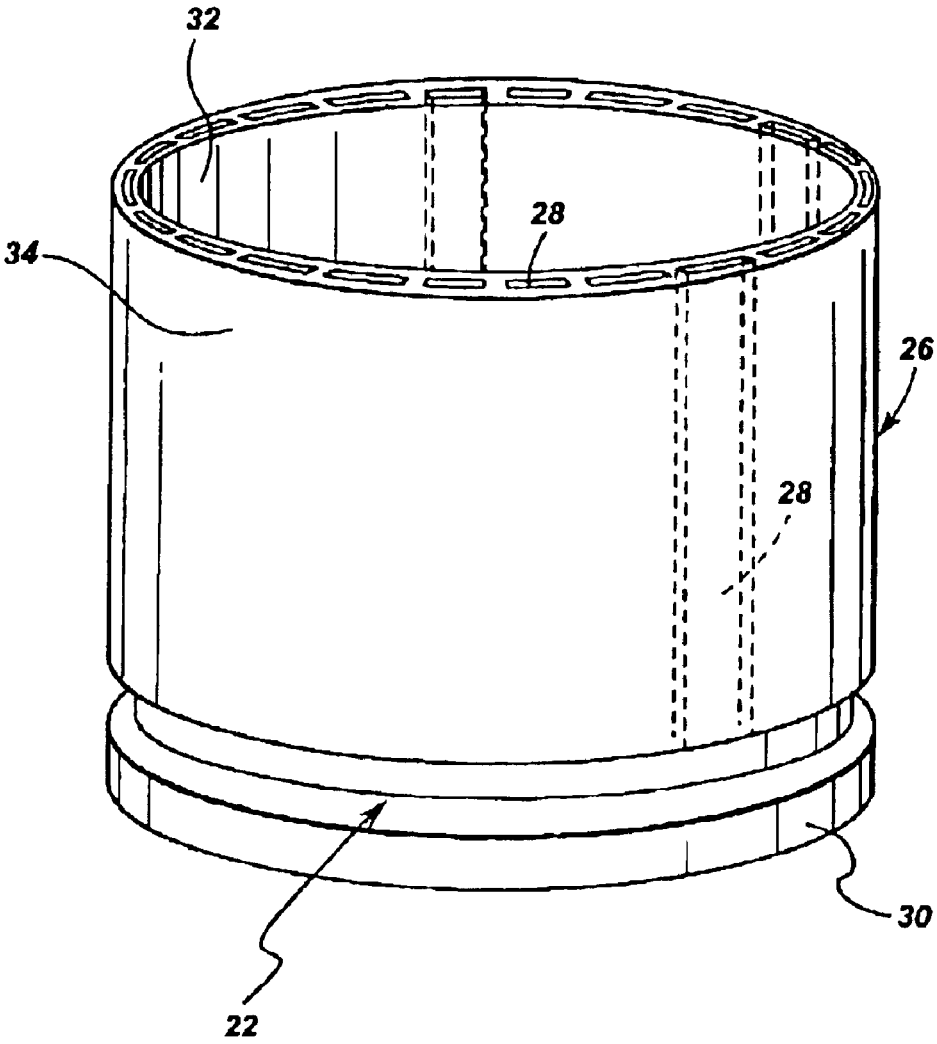
Fig. 2 (Prior Art)
FIG. 2 is a perspective view of a known, axially cooled, cylindrical combustor liner connector segment.

FIG. 2 shows a cylindrical segment 26 that may be used to connect the combustor liner 24 to the transition piece 20. The segment 26 is a body of doubled-walled construction with axially extending cooling channels 28 arranged in circumferentially spaced relationship about the segment. The combustor liner and transition piece may also be of double-walled construction with similar cooling channels. The segment is shown with a radial attachment flange 30, but the manner in which the segment is attached to the combustor liner and transition piece may be varied as required. The segment 26 may be made of a Ni-base superalloy, Haynes 230. Depending on temperatures of individual applications, other materials that could be used include stainless steels, alloys and composites with a Ni-base, Co-base, Fe-base, Ti-base, Cr-base, or Nb-base. An example of a composite is a FeCrAlY metallic matrix reinforced with a W phase, present as particulate, fiber, or laminate. The materials used in the hot wall and cold wall of the segment are not required to be the same alloy. For purposes of this discussion, inner wall 32 of the segment is the "hot" wall, and outer wall 34 is the "cold" wall.

Figure 3:
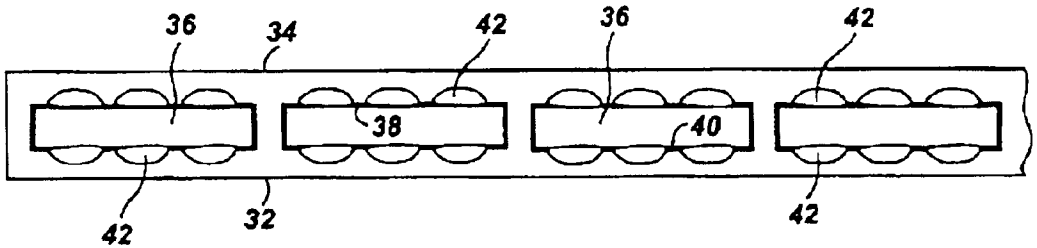
FIG. 3 is a partial cross section of a cylindrical cooling segment, projected onto a horizontal plane, illustrating cooling channels with enhanced cooling features in accordance with the invention.
Figure 4:
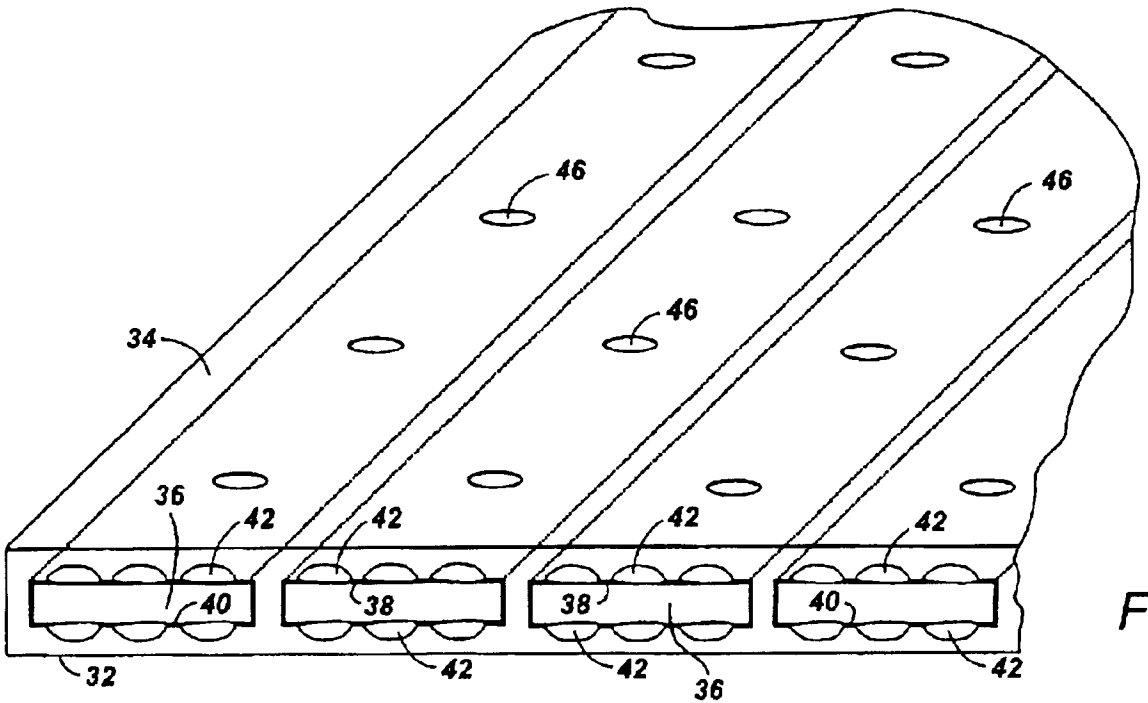
FIG. 4 is a perspective view of the segment in FIG. 3, showing the addition of impingement cooling holes axially spaced along the length of the cooling channels.

Referring now to FIGS. 3 and 4, schematic representations of cooling channel configurations in accordance with this invention are shown. The segment is partially shown in planar form, prior to hoop-rolling into the finished cylindrical shape. It will be understood that the segment shape could also be oval or conical depending on the specific application.

Re-designed cooling channels 36 are elongated and generally rectangular shape, each having upper and lower (or radially outer and inner)surfaces 38, 40, respectively. Based on the previously characterization of radially outer and inner walls 34, 32, it will be appreciated that surface or wall 38 is the "cold" surface or wall and surface or wall 40 is the "hot" surface or wall. In other words, in use, surfaces 32 and 40 are closest to the combustion chamber, while surfaces 34, 38 are closest to the compressor cooling air outside the combustor.

Figure 5:
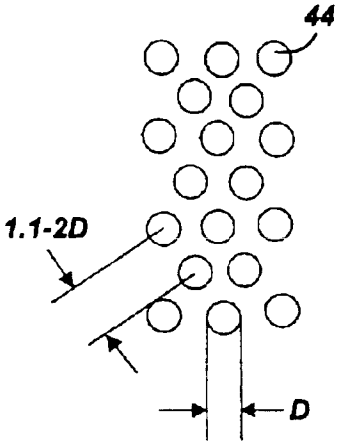
FIG. 5 is a schematic representation of surface concavities, viewed in plan, as they would appear along the length of both major surfaces of a cooling channel.
Figure 6:
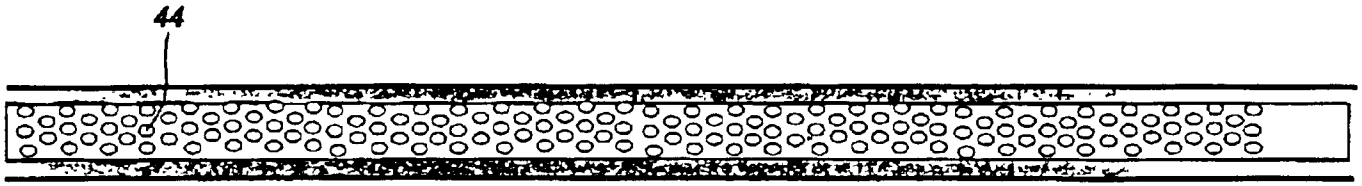
FIG. 6 is a schematic representation of a cooling channel, viewed in plan, and with the top surface of the channel removed, illustrating an array of surface concavities in the lower surface of the channel in accordance with the invention.
Figure 7:
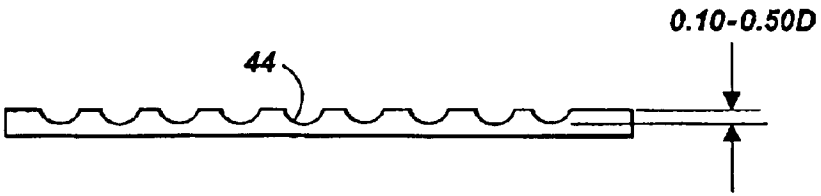
FIG. 7 is a schematic representation of one major surface of a cooling channel illustrating the cross-sectional shape of surface concavities along the interior surface thereof.

Concavities 42 are formed in at least one and preferably both surfaces 40, 38. As best seen in FIGS. 5–7, the concavities 42 are discrete surface indentations, or dimples, that may be semispherical in shape, but the invention is not limited as such. In addition, the concavity surface may be altered for various geometries of dimple spacing, diameters, depths, as well as shapes. For example, for a given dimple diameter D, the center-to-center distance between any two adjacent dimples may be 1.1 D to 2 D, and the depth of the dimples may be 0.10 D to 0.50 D (see FIGS. 5 and 7). Preferably, the channel aspect ratio, defined as the channel height divided by the channel width, is in the range of 1 to 0.2, and more preferably in a range of 0.4 to 0.2. The ratio of channel height to concavity diameter is preferably in the range of 0.25 to 5, and more preferably in the range of 0.5 to 1. The concavities may be formed by simple end-milling, EDM, ECM or laser.

FIGS. 5 and 6 show arrays of dimples 44 that are arranged in staggered rows, but here again, the specific array configuration may vary as desired. Note in FIGS. 6 and 7 that the dimples 44 are ovaloid in shape, as opposed to the circular dimples 42 in FIG. 5.

With reference to FIG. 4, impingement cooling holes 46 may be provided in axially spaced relation along each cooling channel 36. This allows for the spaced introduction of cooling air into the channels 36 along the axial length of the segment, and about its circumference, further enhancing cooling of the segment.

The addition of surface concavities and impingement holes enhances cooling by as much as 100%. This also means that the cooling channels may be extended by a factor of 2 without requiring additional cooling air.

While the invention has been described in connection with what is presently considered to be the most practical and preferred embodiment, it is to be understood that the invention is not to be limited to the disclosed embodiment, but on the contrary, is intended to cover various modifications and equivalent arrangements included within the spirit and scope of the appended claims.

What is claimed is:

1. A connector segment for connecting a combustor liner and a transition piece in a gas turbine comprising a substantially cylindrical body of double-walled construction including radially inner and outer walls and a plurality of discrete cooling channels for receiving cooling air flow, said cooling channels extending axially along the segment, between said radially inner and outer walls, said cooling channels defined in part by radially inner and outer surfaces, wherein both of said radially inner and outer surfaces are formed with an array of concavities, each having a diameter D with center-to-center distance between adjacent concavities is equal to about 1.1–2 D; and further wherein a ratio of channel height to concavity diameter D is in a range of 0.25 to 5.

2. The connector segment of claim 1 and further comprising axially spaced holes in said outer wall communicating with at least some of said cooling channels.

3. The connector segment of claim 1 wherein said concavities are semispherical in shape.

4. The connector segment of claim 3 wherein said concavities are arranged in staggered rows.

5. The connector segment of claim 1 wherein said concavities are circular, and have a diameter D, and wherein a depth of said concavities is equal to about 0.10 to 0.50 D.

6. The connector segment of claim 1 including a plurality of axially spaced impingement holes in each channel.

7. The connector segment of claim 1 wherein said ratio of channel height to concavity diameter is in a range of 0.5 to 1.

8. The connector segment of claim 9 wherein said ratio of channel height to concavity diameter is in a range of 0.5 to 1.

9. A connector segment for connecting a combustor liner and a transition piece in a gas turbine, the connector segment comprising a cylindrical double-walled body including radially inner and outer walls and a plurality of cooling channels extending for receiving cooling air flow, said cooling channels extending axially along the segment, between said radially inner and outer walls, said cooling channels defined in part by radially inner and outer surfaces; a plurality of axially spaced holes in said outer wall communicating with said plurality of cooling channels wherein both of said radially inner and outer surfaces are formed with an array of concavities; and wherein said cooling channels have an aspect ratio of from 0.2 to 1 and a ratio of channel height to concavity diameter is in a range of 0.25 to 5; and further wherein a center-to-center distance between adjacent concavities is equal to about 1.1–2 D.

10. The connector segment of claim 9 wherein said concavities are semispherical in shape.

11. The connector segment of claim 9 wherein said concavities are arranged in staggered rows.

12. The connector segment of claim 9 wherein said concavities are circular, and have a diameter D, and wherein a depth of said concavities is equal to about 0.10 to 0.50 D.

* * * * *

UNITED STATES PATENT AND TRADEMARK OFFICE

CERTIFICATE OF CORRECTION

PATENT NO. : 6,761,031 B2
DATED : July 13, 2004
INVENTOR(S) : Bunker

It is certified that error appears in the above-identified patent and that said Letters Patent is hereby corrected as shown below:

Column 6,
Lines 14-45, renumber and/or amend Claims 8-12 as follows:

8. A connector segment for connecting a combustor liner and a transition piece in a gas turbine, the connector segment comprising a cylindrical double-walled body including radially inner and outer walls and a plurality of cooling channels extending for receiving cooling air flow, said cooling channels extending axially along the segment, between said radially inner and outer walls, said cooling channels defined in part by radially inner and outer surfaces; a plurality of axially spaced holes in said outer wall communicating with said plurality of cooling channels wherein both of said radially inner and outer surfaces are formed with an array of concavities; and wherein said cooling channels have an aspect ratio of from 0.2 to 1 and a ratio of channel height to concavity diameter is in a range of 0.25 to 5; and further wherein a center-to-center distance between adjacent concavities is equal to about 1.1-2D.

9. The connector segment of claim 8 wherein said ratio of channel height to concavity diameter is in a range of .5 to 1.

10. The connector segment of claim 8 wherein said concavities are semispherical in shape 11. The connector segment of claim 8 wherein said concavities are arranged in staggered rows.

12. The connector segment of claim 8 wherein said concavities are circular, and have a diameter D, and wherein a depth of said concavities is equal to about 0.10 to 0.50D.

Signed and Sealed this

Seventh Day of December, 2004

JON W. DUDAS
*Director of the United States Patent and Trademark Office*